United States Patent [19]

Clive-Smith

[11] 4,162,737

[45] Jul. 31, 1979

[54] COLLAPSIBLE CONTAINER

[75] Inventor: Martin Clive-Smith, London, England

[73] Assignee: Sea Containers, Ltd., London, England

[21] Appl. No.: 938,789

[22] Filed: Sep. 1, 1978

Related U.S. Application Data

[62] Division of Ser. No. 803,614, Jun. 6, 1977, abandoned.

[30] Foreign Application Priority Data

Jun. 4, 1976 [GB] United Kingdom ..... 23317/76

[51] Int. Cl.[2] ..... B65D 21/02; B65D 7/28; B65J 1/02

[52] U.S. Cl. ..... 220/1.5; 206/512; 220/6; 220/7

[58] Field of Search ..... 220/1.5, 6, 7; 206/511, 206/512

[56] References Cited

U.S. PATENT DOCUMENTS

| | | | |
|---|---|---|---|
| 3,402,845 | 9/1968 | Erickson | 220/1.5 |
| 3,529,741 | 9/1970 | Walker | 220/1.5 |
| 3,591,033 | 7/1971 | Paitridge | 220/1.5 |
| 3,612,330 | 10/1971 | Baer | 220/1.5 |
| 3,620,388 | 11/1971 | Mansson | 220/1.5 |
| 3,807,851 | 4/1974 | Nichols | 220/1.5 |
| 3,840,133 | 10/1974 | Bridge | 220/1.5 |

*Primary Examiner*—George E. Lowrance
*Attorney, Agent, or Firm*—Blanchard, Flynn, Thiel, Boutell & Tanis

[57] ABSTRACT

A collapsible container of the open-platform type for containing goods comprises a generally rectangular platform base having a stub corner post at each corner of the platform base. At its upper end, each corner post has means for coupling it to a bottom corner portion of a superimposed container. A corner post is pivotally connected to each stub corner post about an axis substantially parallel to the longer side of the base for movement from a folded-down position in which it lies below the level of the tops of the stub corner posts, through a vertical position into a position slightly beyond the vertical to enable bracing means to be swung upwards and coupled between the two corner posts at each of the two ends of the frame to hold them in their vertical positions. The tops of the corner post also carry coupling means to enable them to be coupled in their vertical position to the underside of a similar container, the bracing means and the pivotal connections then ensuring that the corner posts remain vertical despite the normal racking loads.

7 Claims, 8 Drawing Figures

COLLAPSIBLE CONTAINER

Figure 1:
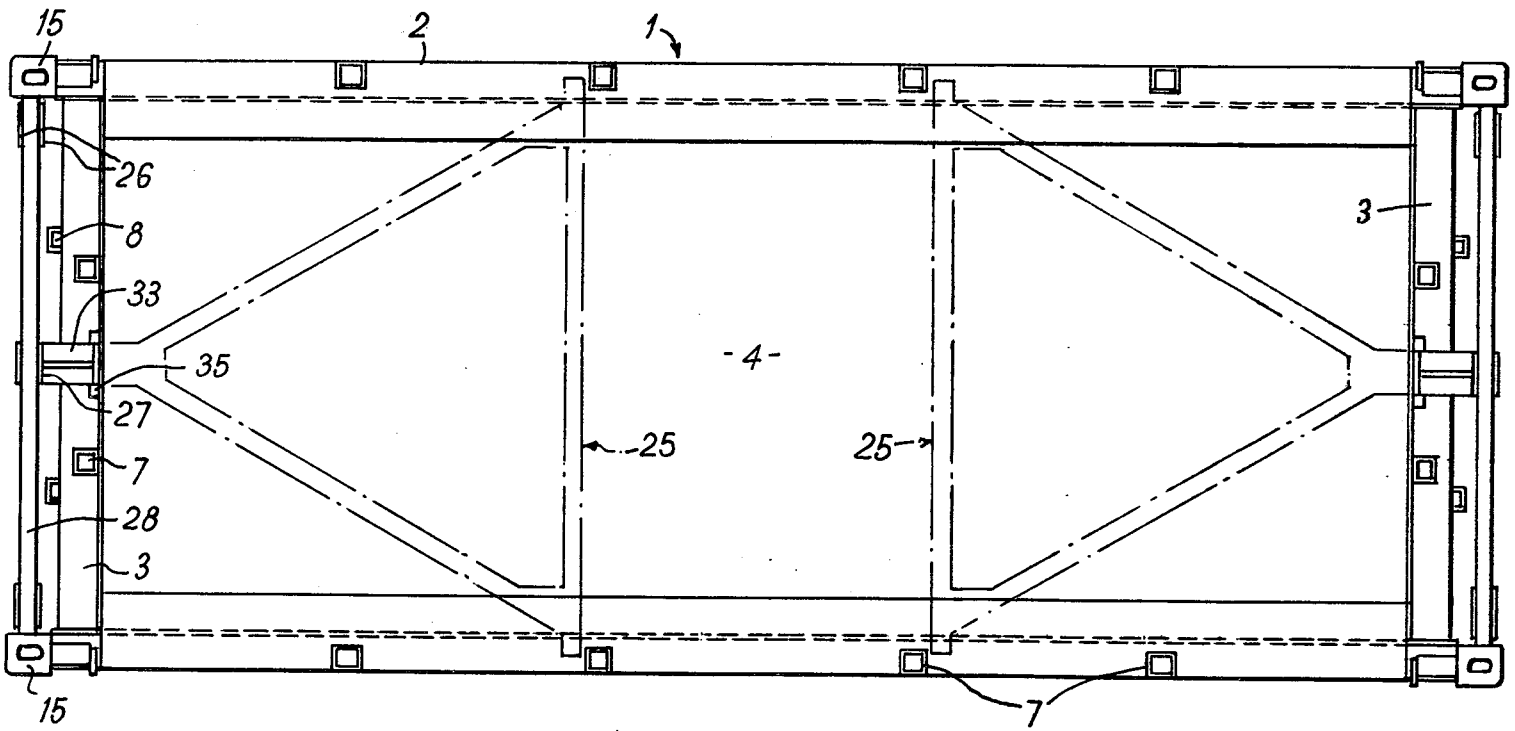

This is a division of application Ser. No. 803,614 filed June 6, 1977 now abandoned.

BACKGROUND OF THE INVENTION

This invention relates to collapsible containers of the open-platform type in which goods to be transported can be placed on the platform base of a container, the containers being capable of being stacked for transport one on top of another either in the loaded condition or in a collapsed, unloaded condition.

PRIOR ART

Containers of this kind are known for example from U.S. Specification No. 3,807,581 (Nichols, Apr. 30th, 1974) and 3,402,845 (Eriksson, Sept. 24th, 1968).

OBJECT OF THE INVENTION

An object of the invention is to provide a collapsible container of the open-platform type which, both when erected and when collapsed is capable of meeting International Standards in respect of its ability to support a stack of superimposed containers and which when erected will provide an unobstructed loading space between structures at opposite ends of the platform so that loads of the full width of the container, the full height of the container and of the full length from one end structure to the other can be carried in the container, while a plurality of the containers when empty can be collapsed, secured together and transported within the space required by one erected container.

BRIEF DESCRIPTION OF THE INVENTION

According to the invention there is provided a collapsible container of the open-platform type for conveying goods, said container comprising a generally rectangular platform base, a stub corner post at each corner of the platform base, a corner post pivotally connected to each stub corner post about an axis substantially parallel to the longer side of the base for pivotal movement from a folded-down position, in which it rests either on the base or on the other folded-down corner posts at that end of the base, through a vertical position into a position beyond the vertical, and bracing means for detachably holding the corner posts vertical.

Advantageously, the articulation of each corner post to its stub corner post comprises a pivotal connection of axial length equal to the width of the corner post as measured in the length direction i.e. that of the longer side of the platform. This ensures stiffness of the corner post assembly against racking forces in the length direction of the container.

Preferably, the bracing means are detachably securable to the corner posts at positions adjacent their upper ends. The bracing means may include a tie which in operation is secured to the two corner posts adjacent their upper ends and extend directly between them. In the presently preferred form, the bracing means comprises a triangular frame one side of which forms the tie while the opposite apex cooperates with abutment means on the base at least to limit movement of the apex transversely of the length direction.

Conveniently, the frame is held captive to the base for example by an articulation between the base and the frame near the apex so that the frame can be swung down onto the base when collapsing the container.

Preferably, the articulation is slack and separate from the abutment means so that no loads are transmitted through it in the erected position, particularly under transverse racking forces.

In alternate embodiments, the frame may be a full panel where appropriate the thrust points between the frame and the base may be in the region of the stub corner posts, for example at the articulations between the corner posts and their stub corner posts.

Figure 2:
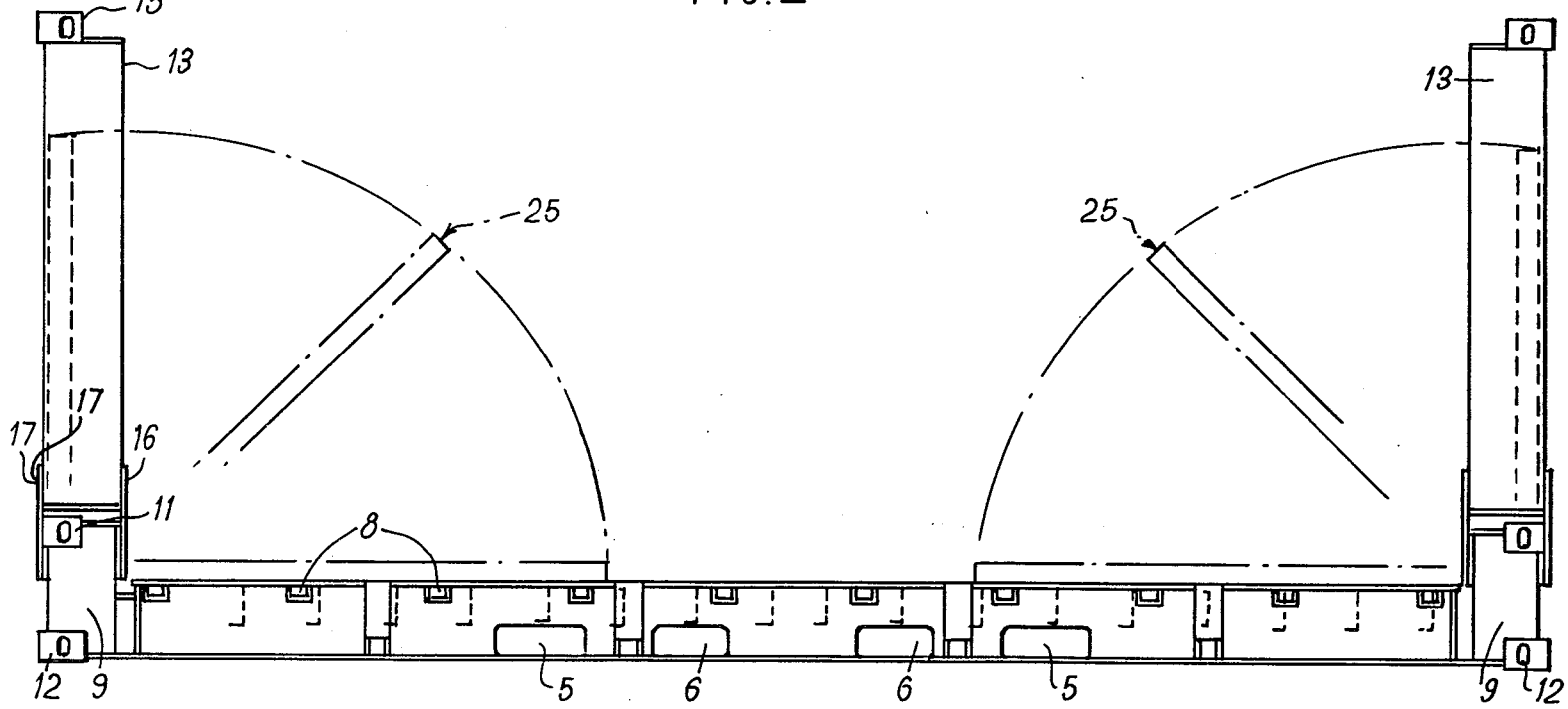

An embodiment of the invention will now be described by way of example with reference to the accompanying drawings, in which:

FIG. 1 is a plan view of a collapsible container in accordance with the invention shown in the erected state, FIG. 2 is a side elevation view of the container shown in FIG. 1.

Figure 3:
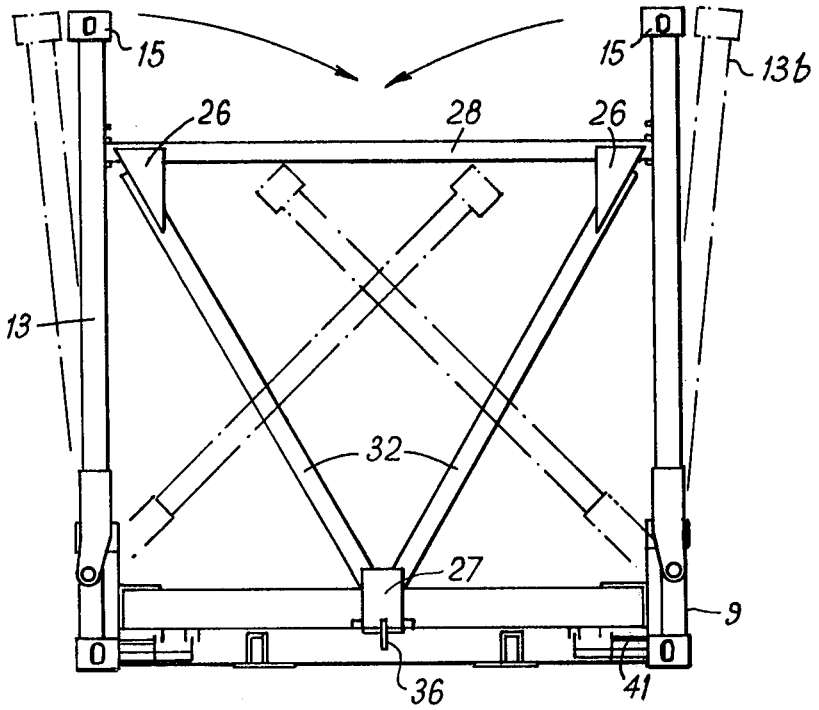
Figure 4:
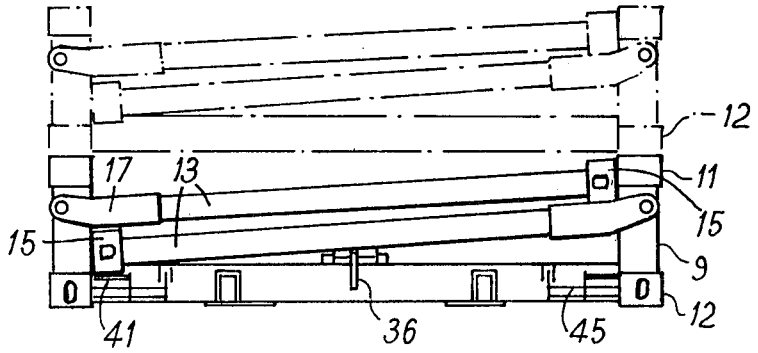
Figure 5:
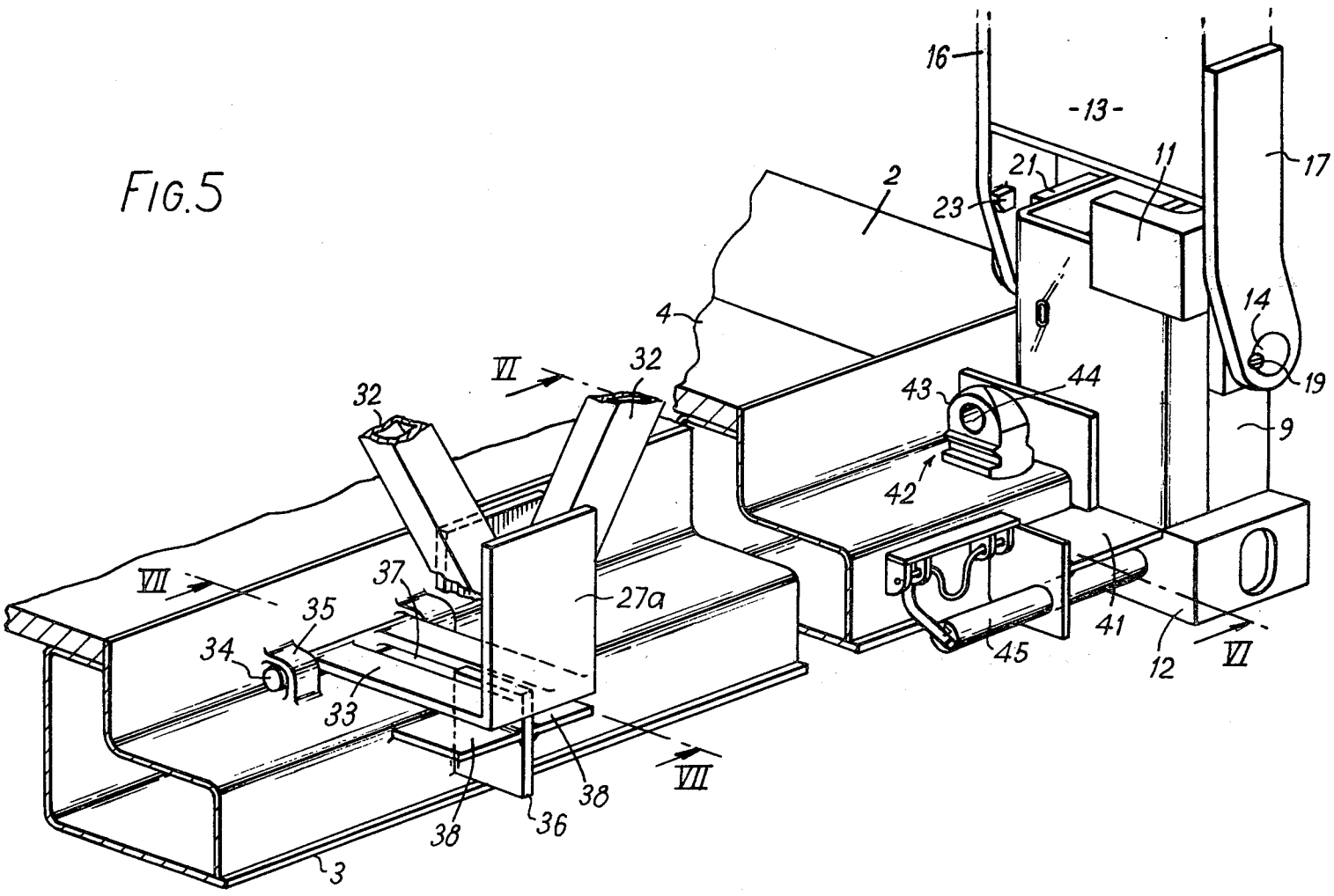
Figure 6:
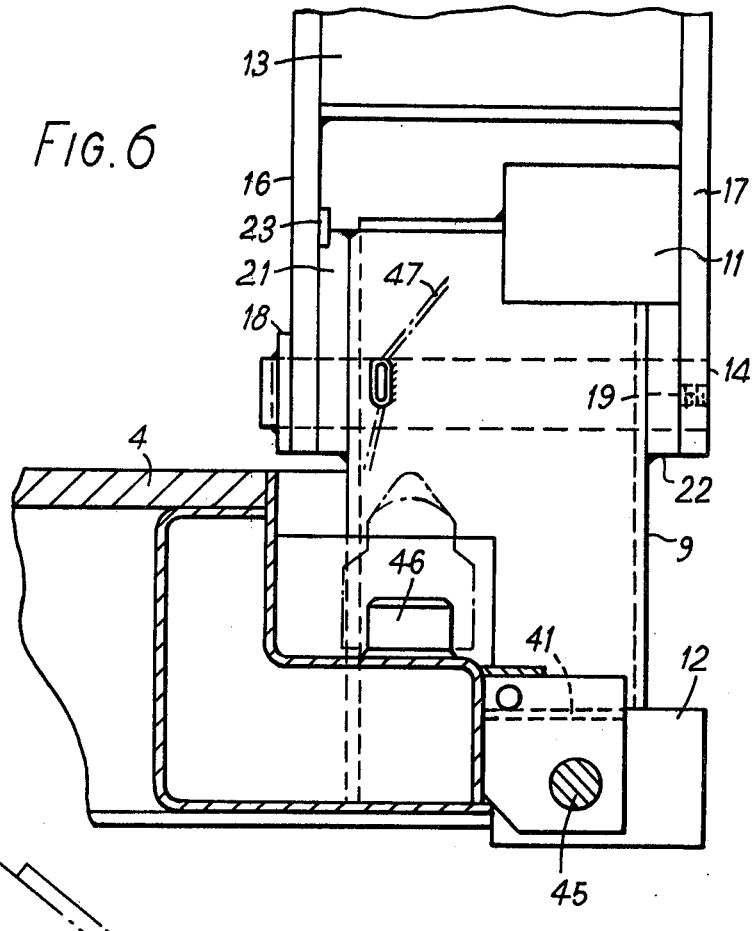
Figure 7:
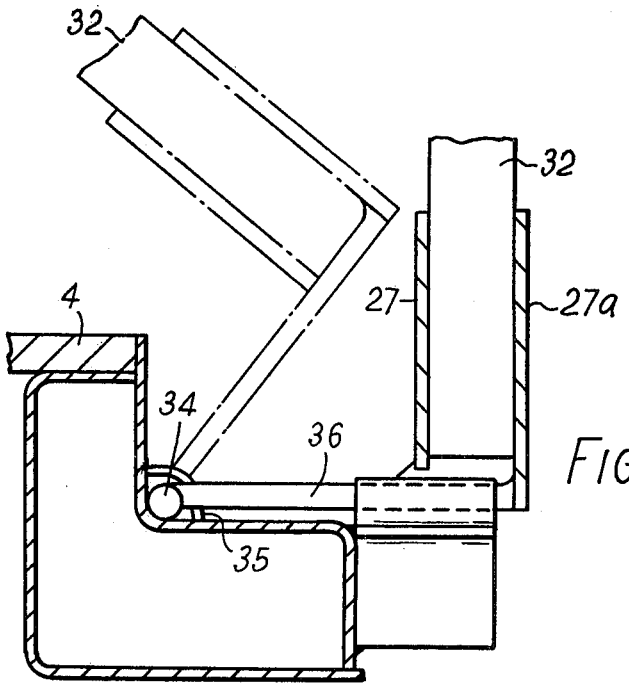
Figure 8:
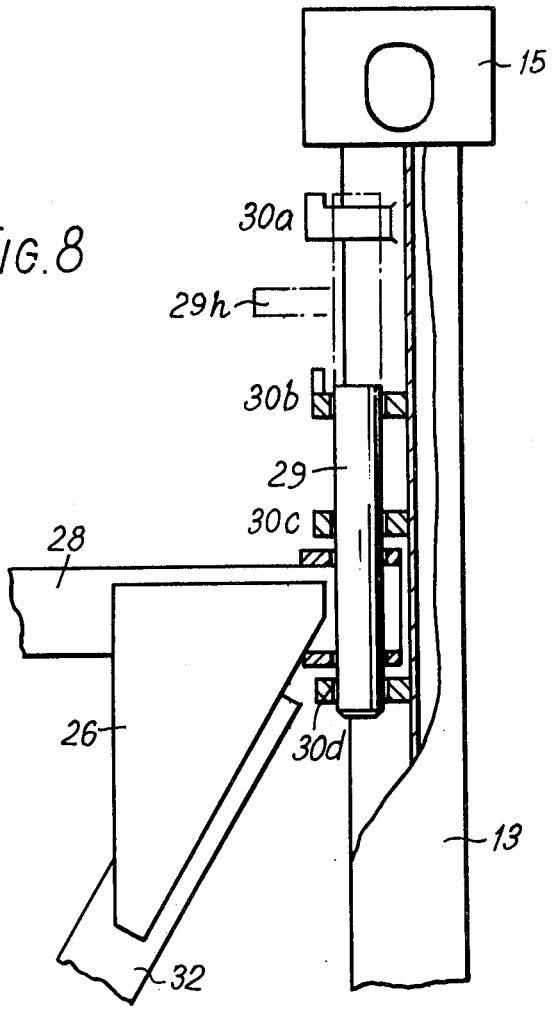

FIG. 3 is an end elevational view of the container shown in FIG. 1, in the erected condition, FIG. 4 is an end elevational view of the container in the collapsed condition with a second collapsed container secured on top of it, the second container being shown in broken lines, FIG. 5 shows portions of FIGS. 3 and 4 on an enlarged scale, FIGS. 6 and 7 are cross-sections on the lines VI—VI and VII—VII respectively of FIG. 5, FIG. 7 is a perspective view of the lower end of the bracing frame, and FIG. 8 shows the arrangement for latching an upper end of the bracing frame to the upper part of a corner post in the erected condition of the container.

The container shown in the drawings comprises a platform base 1 which, as can be seen in FIG. 1, is rectangular in outline and has a fabricated steel frame including side members 2 and end members 3. Timber decking 4 is carried on joists (not shown for reasons of clarity) which extend between the side members 2. The side and end members 2 and 3 are of substantial box-section construction and together with the joists provide the platform base 1 with sufficient rigidity to carry the designed load on the container, for example when the container is lifted by a sling attached to each corner of the container or by the lifting fork of a fork-lift truck engaged in transverse passageways 5 (FIG. 2) in the platform base 1. A further pair of fork-lift passageways 6 enables the container when empty to be lifted by a smaller size of fork-lift truck.

The platform base 1 conforms to I.S.O. Standards in respect of its dimensions and load carrying capacity. The side and end members 2 and 3 are formed with square-section sockets for stanchions when the latter are required to assist in securing cargoes such as round steel bars. In addition, the side and end members have roping points 8 formed by loops of steel rods welded to the side and end members 2 and 3.

The platform base 1 has a stub corner post 9 which projects to a short distance upwards above the top surface of the decking 4. At its upper and lower ends, each stub corner post 9 has upper and lower corner castings 11 and 12 by which the container may be secured to I.S.O. Standard containers above or below the container.

In horizontal cross-section, each stub corner post 9 is longer in the length direction of the container (i.e. in the direction of the sides 2) than in the transverse direction (i.e. parallel to the ends 3). A corner post 13 is pivotally mounted on each stub corner post 9 by means of a massive hinge pin 14 the axis of which is horizontal and substantially parallel to the side members 3. At its upper end, each corner post 13 carries a standard corner casting 15 which can accordingly be secured to the underside of superimposed I.S.O. Standard container.

The lower end of each corner post 13 is secured to the hinge pin 14 by means of hinge plates 16 and 17 (see particularly FIGS. 4 and 6) welded to the narrower faces of the respective corner post 13. The hinge pin 14 passes through holes in the lower ends of the hinge plates 16 and 17 and its in board end has a washer 18 welded to it to form a locating flange while its outer board end is flush with the outer face of the hinge plate 17 and is locked to the outer hinge plate 17 by means of a grub screw 19 located in a tapped hole formed half in the hinge pin 14 and half in the hinge plate 17. The intermediate portion of the hinge pin 14 is free to turn in a bore in the stub corner post 9 which provides adequate supporting surfaces for the hinge pin particularly in the regions adjacent the hinge plates 16 and 17. For this purpose, the stub corner post 9 is reinforced in this region by plates 21 and 22 welded to the faces of the stub corner post 9.

The hinge plates 16 and 17 space the lower end of the corner post 13 a short distance above the top face of the corner casting 11 at the top of the stub corner post 9 when the corner post 13 is upright so that the corner post 13, and any load carried by it, is transmitted to the stub corner post 9 solely through the hinge pin 14. As shown in FIG. 3, the corner post 13 can in fact be swung through the vertical position to an outwardly inclined position shown at 13*b* in FIG. 3, this position being determined by a stop 23 welded to the hinge plate 16 in a position to abut the plate 21 when the corner post 13 reaches its position 13*b*.

The hinge plates 16 and 17 are spaced sufficiently far apart to ensure, in conjunction with the massive construction of the hinge pin 14, that the corner posts 13 can withstand horizontal racking forces in the length direction, as prescribed by the I.S.O. Standards. In order to secure the corner posts in vertical positions in the erected condition of the container, and to brace the container transversely so that it can meet the prescribed standard tests for transverse racking loads, an equilateral triangular bracing frame 25 is provided for each end of the container. The bracing frame is fabricated from lengths of square-section tubing to which are welded appropriate gusset plates 26 and 27. One tubular element 28 of each bracing frame forms a tie between upper portions of the two corner posts 13 and is connected at each end to the respective corner post by a sliding bolt arrangement shown in detail in FIG. 8. For this purpose, the top member 28 of the bracing frame projects beyond the gusset plate 26 and has a vertically oriented bore to receive a locking bolt 29 which is vertically slidable in aligned bores in plates 30*a*, 30*b*, 30*c* and 30*d* welded to the corner post 13. The bolt 29 has a handle 29*h* and the plates 30*a* and 30*b* have lugs 31 for holding the handling in upper and lower positions in which the top member 28 is respectively freed and held captive.

The two downwardly inclined members 32 of the bracing frame 25 are joined at the lower apex of the frame by the gusset plates 27 one of which has a cranked and slotted extension 33 carrying at its free end a pair of pin portions 34 which are loosely held captive in loops 35 welded into the corner of a step formation in the end member 3. In this way, the bracing frame 25 is held captive to the end member 3 while being capable of being swung between a vertical position and a substantially horizontal stowed position in which it lies on the decking 4. In the vertical position of the bracing frame 25, a tongue 36 on the end member 3 projects upwards through the slots 37 in the cranked portion 33 with a working clearance. The tongue 36 is reinforced by horizontal plates 38 welded to it and to the end member 3 and limits horizontal movement of the gusset plate 27*a* and thus of the lower apex of the bracing frame 25. This in turn effectively limits deformation of the parallelogram formed by the two corner posts, the platform base and the top bracing member 28 to a very small magnitude corresponding to the working clearance between the tongue 36 and the slot 37. However, vertical movement between the tongue 36 and the slot 37 is not limited so that substantially no vertical force components are transmitted between the lower apex of the bracing frame and the base member 3. Instead, all vertical components are transmitted through the corner posts and their hinges and hence through the stub corner posts to the bottom corner castings 12.

In use, the container in its erected form has the shape shown in full lines in FIGS. 1 to 3. As previously mentioned, the whole of the space between the end structures formed by a pair of corner posts 13 and their bracing frame 25, is available for loading. For example, flat boards equal in width to the transverse width of the platform base 1 and of length up to the distance between the hinge plate 16 at opposite ends of the container may be loaded on the platform base without exceeding the I.S.O. dimensional standards. Since the platform base will be supported on a lower container through the four lower corner castings 12, some slight downward flexing of the container base may be expected when fully loaded. Since it is important that top corner casting 15 at opposite ends of the container should be at the correct distance apart in the loaded state of the container to enable a further container to be secured to them, it may be found desirable to tilt the axes of the hinge pin slightly so that the corner posts, as seen from the side as in FIG. 2, are inclined slightly outwardly. Alternatively, the inner hinge plate 16 may be set slightly further down its corner post 13 than the out board hinge plate 17 to provide the required slight outward lean in the length direction of the container. In this case, the axis of each pin 14 can be horizontal, but should be set at a slight angle to the length direction of the container to ensure that in the collapsed condition of the container shown in FIG. 4, the top casting 15 does not project beyond the end plane of the container as determined by the end plane of the bottom corner castings 12.

When it is desired to collapse an erected container after the latter has been unloaded, all that is necessary is to collapse the two end structures. Each end structure is collapsed by first sliding the two bolts 29 to their uppermost positions in their corner posts 13 with their angles 29*h* resting on the uppermost plate 30*a*. As each bolt 29 is lifted, its corner post 13 is tilted outwards to the position shown at 13*b* in FIG. 3 where it will be clear of the end of the top member 28 and further unable to drop inwards accidentally onto the container base. When both bolts have been released from the top member 28, the bracing frame 25 is lowered onto the container base 1 into the position shown in broken lines in FIG. 1. Next, each corner post 13 can be brought back from the position 13*b* through the vertical position and lowered. The first corner post to be lowered is allowed to descend until its top casting 15 rests on a plate 41 adjacent the opposite bottom corner casting 12. The second, opposite corner post is then lowered until its top casting 15 rests on the out board hinge plate 17 of the first corner post to be lowered. In order to ensure that the top casting 15 of the second corner post to be lowered lies below the top casting 11 of the stub corner post, the hinge plates 16 and 17 are preferably formed with the "dog-leg" shape shown particularly in FIGS. 3 and 4, the hinge pins 14 being located transversely beyond the centre lines of the corner post 13 and their stub corner posts 9.

As indicated in FIG. 4, a plurality of collapsed containers may be assembled into a stack and the heights chosen for the stub corner posts may be such at a stack of say four or five collapsed containers has the same height as a standard container. The adjacent collapsed containers in the stack are secured together by "cones" 42, each cone having a ribbed base which slides into and engages the side of a slot in the top face of the corner casting 11 and an upwardly projecting lug portion 43 which projects into the underside of a superimposed bottom corner casting 12 and has a transverse bore 44 to receive a sliding bolt 45 on the superimposed container. The cones have an opening in their base by means of which they can be engaged over tongues 46 on the container end member 3 when not in use. To prevent loss, the cones are connected to the stub corner post by chains 47.

Erection of a collapsed container is carried out by reversing the steps described above for collapsing an erected container.

I claim:

1. In a collapsible container of the open-platform type for conveying goods, said container including a generally elongated rectangular platform base, said base defining a pair of parallel side edges and a pair of parallel end edges extending transversely between said side edges, said side edges being longer than said end edges, a stub post at each corner of the platform base, a corner post pivotally connected to each stub post about an axis substantially parallel to the side edge of the base for permitting pivotal movement of the corner post from a fold-down position, in which the corner post rests either on the base or on the other folded down corner post at that end of the base, into a substantially upright position, and bracing means for holding the corner posts in said upright position, comprising the improvement wherein said bracing means includes a bracing structure associated with each end of said container, said bracing structure when in a bracing position extending between and rigidly connecting the opposed pair of corner posts as located adjacent one of said end edges, said bracing structure being detachable from at least one of the corner posts of said pair and movable into a collapsed position wherein it overlies the base when said posts are in said fold-down position, and the sides of said container as measured along the side edges between the opposed corner posts being completely open and free of bracing or obstructions.

2. A container according to claim 1, wherein said bracing structure comprises a rigid truss-like frame connected between the opposed pair of legs and said base adjacent the end edge thereof.

3. A container according to claim 2, wherein said frame is pivotally connected to said base for swinging movement about a pivot axis which extends approximately parallel with the adjacent end edge so that said frame can be swingably moved from a vertical upright position into a fold-down position, and releasable connecting means coacting between the opposite ends of said frame and the opposed corner posts adjacent the upper ends thereof for permitting disconnection of said frame from said corner posts.

4. A container according to claim 3, wherein said frame has a configuration approximating an inverted triangle when in said upright position, said frame defining at the lower end thereof an apex of said triangular configuration, said apex being hingedly connected to said base.

5. A container according to claim 4, including horizontally opposed abutment means coacting between the apex of said frame and said base to prevent movement of said frame transversely in a direction parallel to said end edge, said abutment means permitting said apex to freely move vertically relative to said base through at least a limited extent.

6. A container according to claim 5, wherein the hinged connection between said apex and said base is slack and separate from the abutment means so that substantially no load is transmitted through the hinged connection when the frame is in its upright position due to transverse racking forces imposed on said corner posts.

7. In a collapsible container of the open-platform type for transporting goods, said container including a generally elongated rectangular platform-type base defining thereon an upper horizontal support surface, said base defining a pair of opposed parallel side edges joined together by a pair of opposed parallel end edges extending perpendicularly between said side edges, said end edges being substantially shorter than said side edges, a stub post fixed at each corner of the base, a corner post pivotally connected to each stub post about an axis substantially parallel to the longer side of the base for permitting pivotal movement of the corner post from a folded-down position, in which it rests either on the base or on the other folded-down corner post at that end of the base, into a substantially upright position, and bracing means coacting between the corner posts and said base for holding the corner posts in said upright position, comprising the improvement wherein a hinge structure is provided for pivotally connecting the respective corner and stub posts together, said hinge structure including a rigid vertical tube of substantially rectangular cross section fixedly associated with one of said posts and a yoke structure fixedly associated with the other post and disposed in straddling relationship to said tube, said hinge structure also including an axially elongated hinge pin extending across said tube and through the opposite side walls thereof for connection to the two legs of said yoke structure to permit pivoting movement between said tube and said yoke structure, said bracing means being located solely at the ends of said container, and the sides of said container being totally unobstructed and free of bracing so as to provide full access to said container through the sides thereof.

* * * * *